United States Patent [19]

Klucker

[11] Patent Number: 4,488,849

[45] Date of Patent: Dec. 18, 1984

[54] POWER SHOVEL

[75] Inventor: Klaus Klucker, Lübeck, Fed. Rep. of Germany

[73] Assignee: O & K Orenstein & Koppel Aktiengesellschaft, Fed. Rep. of Germany

[21] Appl. No.: 427,574

[22] Filed: Sep. 29, 1982

[30] Foreign Application Priority Data

Oct. 9, 1981 [DE] Fed. Rep. of Germany ..... 3140223

[51] Int. Cl.[3] ..... B65G 47/16

[52] U.S. Cl. ..... 414/566; 212/242; 414/693

[58] Field of Search ..... 414/693, 565; 212/190, 212/242

[56] References Cited

U.S. PATENT DOCUMENTS

| | | | |
|---|---|---|---|
| 3,127,038 | 3/1964 | Allard | 414/565 |
| 3,206,048 | 9/1965 | Weiss et al. | 414/565 |
| 3,517,840 | 6/1970 | Schneider | 414/565 |

*Primary Examiner*—Robert J. Spar
*Assistant Examiner*—Donald W. Underwood
*Attorney, Agent, or Firm*—McGlew and Tuttle

[57] ABSTRACT

A power shovel comprises a boom which is supported on an undercarriage and can be lifted and lowered. A hydraulically operated shovel mechanism is mounted at a front end of the boom before pivoting about a horizontal axis. The shoveling mechanism carries a pivotable shovel and at least one cable pulley. A cable hoisting gear engaged with the boom is operable to move the boom. A cable of the cable hoisting gear is trained or reeved on the cable pulley of the shoveling mechanism so that the shoveling mechanism can be moved by the hoisting gear with movement of the boom.

4 Claims, 1 Drawing Figure

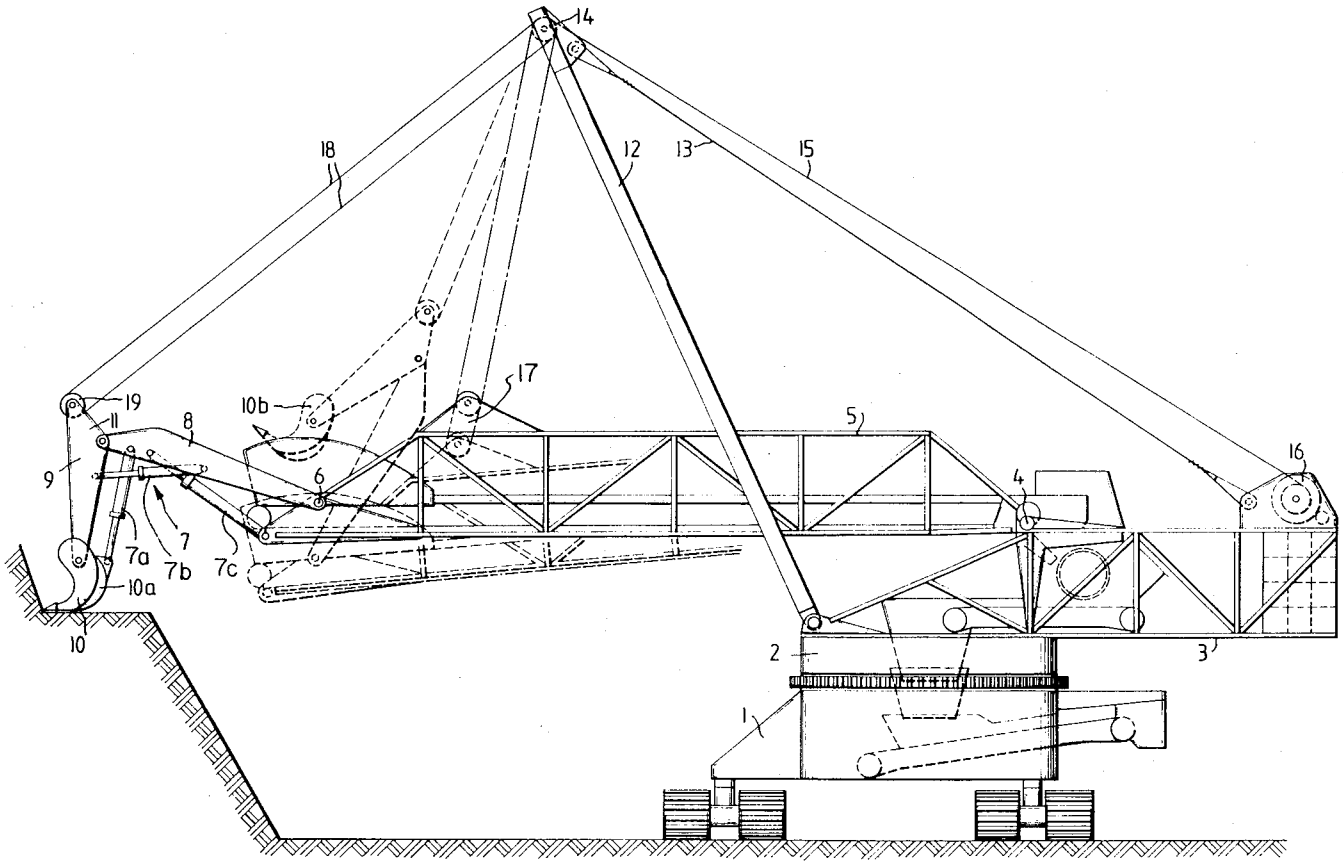
1
2
3
4
5
6
7
7a
7b
7c
8
9
10
10a
10b
11
12
13
14
15
16
17
18
19

POWER SHOVEL

FIELD AND BACKGROUND OF THE INVENTION

The present invention relates in general to power shovels and in particular to a new and useful power shovel having a boom hoisting cable which is reeved around a hydraulically operated shoveling mechanism for moving a shovel connected thereto.

Giant bucket-wheel excavators have proven to be satisfactory as working machines in open-pit mines. Their use raises difficulties however, if the material to be excavated is very hard or mechanically resistant. In such instances, special equipment must be employed.

A tunnel excavator is known, which has a frontally mounted shovel and is equipped with a boom that carries a conveyor and is movable vertically and horzontally. The shovel is provided with movable striking teeth (prongs) projecting from the cutting blade. Such equipment is usable under special conditions, yet not for all mining purposes, particularly not for dislodging beds or bands of hard rock (German Pat. No. 560,030).

SUMMARY OF THE INVENTION

The present invention is directed to a device for ensuring open-pit operations even if the rock to be excavated is a stratified cleft formation or if individual ore or coal deposits are to be worked. The amount of energy needed for the digging and removal is to be minimized. On the other hand, maximum digging forces are to be produced at low costs and with a high power efficiency.

Accordingly, an object of the present invention is to provide a power shovel which comprises a carriage, a boom supported on the carriage for movement to lift and lower the boom, a hydraulically operated shoveling mechanism mounted to a front end of the boom for pivotal motion about a horizontal axis, a shovel mounted to the shoveling mechanism, a cable pulley on the shoveling mechanism and cable hoisting gear having a cable engaged with the boom and reeved around the cable pulley for moving the shovel with movement of the boom.

The invention has the advantage of permitting an economical excavation even if, for example, sandstone or marl layers occur in the stripped formation which are cleft in the direction of their stratification, or if relatively thin coal seams are to be won. Another advantage of the invention is that the lifting power and advance thrust of the shovel are increased beyond the forces which can be produced by the hydraulic drive. Further, during the hoisting of the shovel filled with excavated material, the lifting cylinder of the shoveling mechanism is relieved, so that energy is saved. Also, while lowering the shoveling mechanism, the energy of the hydraulic drive is no longer converted to heat, as is otherwise usual, so that the hydraulic drive need not be cooled to such a high extent as hitherto required.

According to a development of the invention, a shovel arm of the shoveling mechanism may be provided at its rear end with a bracket for carrying on its upper end portion, cable pulleys around which the hoisting cable is trained once or several times. In this embodiment, all the above-mentioned advantages are preserved and the advance thrust of the shovel is augmented in addition.

Another object of the present invention is to provide a power shovel which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

The only drawing in the application is a side elevational view of an excavator in accordance with the invention.

DESCRIPTION OF THE PREFERRED EMBODIMENT

Referring to the drawing in particular, the power shovel of the invention comprises a crawler 1 as the traveling undercarriage. Through a ball-bearing swivel gear, crawler 1 supports a rotary platform 2 to which a supporting truss 3 is firmly secured. A boom 5 is mounted on truss 3 for pivoting about a horizontal axis 4. On the front end of the boom, a shoveling mechanism 7 is mounted for pivoting about a horizontal bearing 6. The shoveling mechanism comprises a shovel jib 8, a shovel arm 9, and the shovel 10. Shovel arm 9 is provided on its rear end with a bracket 11 rigidly secured thereto.

Rotary platform 2 further supports a cable brace 12 which is anchored through a guy cable 13 to the rear end of truss 3. On its upper end, cable brace 12 carries a cable pulley head 14 over which a hoisting cable 15 is passed leading to a cable winch 16.

Hoisting cable 15 is reeved partly between cable pulley head 14 of brace 12 and a cable pulley set 17 which is provided on boom 5, and one or more cable parts 18 are run between cable pulley head 14 and cable pulleys 19 which are mounted on bracket 11. The FIGURE shows shovel 10 in its digging position **10*a* and indicates at 10*b*** its emptying position.

It is evident from the FIGURE that while lifting shovel 10, boom 5 is lowered through a distance corresponding to the reeving of the cable. It may also clearly be learned from the drawing that the advance thrust and lifting power of shovel 10 are augmented without the need of additional energy.

The shoveling mechanism 7 includes a first hydraulic piston and cylinder combination **7*a* which pivots shovel 10 on shovel arm 9. A second hydraulic piston and cylinder combination 7*b* moves arm 9 with respect to shovel jib 8 and a third piston and cylinder combination 7*c* moves jib 8 with respect to boom 5**.

Winch 16 can be utilized, without the use of hydraulic cylinder **7*a*, *b* or *c*, to lift the shoveling mechanism 7 into its unloading position for shovel 10, at 10*b*. In this position the material in shovel 10 can be discharged onto a conveyor in boom 5, with the material being conveyed in a direction toward carriage 1**.

While a specific embodiment of the invention has been shown and described in detail to illustrate the application of the principles of the invention, it will be understood that the invention may be embodied otherwise without departing from such principles.

What is claimed is:

1. A power shovel comprising a carriage, a boom supported on said carriage for lifting and lowering movement, a hydraulically operated shoveling mechanism mounted at a front end of said boom away from said carriage for pivotal motion about a horizontal axis, a shovel connected to said shoveling mechanism, at least one cable pulley rotatably mounted to said shoveling mechanism, a cable hoisting gear engaged with said boom for moving said boom and having a cable reeved on said at least one cable pulley for moving said shoveling mechanism with movement of said cable, said shoveling mechanism including a shovel arm pivotally mounted to said boom and pivotally receiving said shovel, said shovel arm having at a rear end thereof facing said boom a bracket for carrying said at least one cable pulley, said at least one cable pulley being mounted at an upper end of said bracket, and a shovel jib pivotally mounted to said boom and pivotally receiving said bracket at a point on said bracket between said at least one cable pulley and said shovel.

2. A power shovel according to claim 1, including a first piston and cylinder combination connected between said jib and said shovel, a second piston and cylinder combination connected between said jib and said bracket and a third piston and cylinder combination connected between said boom and said jib.

3. A power shovel comprising:

a platform (2);

a boom (5) having one end pivotally mounted to said platform for pivotal movement about a horizontal axis, said boom including a conveyor for moving material from an opposite end of said boom to said one end of said boom;

a first pulley set (17) connected to said boom for guiding a cable;

a hydraulically operated shoveling mechanism (7) mounted to said opposite end of said boom for pivotal movement about a horizontal axis, said shoveling mechanism including a pivotally mounted shovel arm (9) for pivotal movement about a horizontal axis having a lower end and an upper end;

a shovel (10) pivotally mounted to said lower end of said shovel arm;

a second pulley set (19) for guiding a cable connected to said upper end of said shovel arm; and cable wench means (16) connected to said platform and including a cable (15,18) reeved over said first and second pulley sets for synchronized movement of said shovel arm and said boom whereby said shovel can be pivoted into a position over said opposite end of said boom while said opposite end of said boom is lowered through the action of said wench means and said cable.

4. A power shovel according to claim 3, including a cable brace (12) pivotally mounted to said platform at a location spaced from said wench means, said cable brace including an upper end extending above said boom, a pulley head mounted to said upper end of said cable brace with said cable of said wench means reeved over said pulley head for supporting said boom, said shoveling mechanism and said shovel.

* * * * *